US006075314A

United States Patent [19]

Huettinger et al.

[11] Patent Number: 6,075,314

[45] Date of Patent: Jun. 13, 2000

[54] METAL-HALIDE LAMP WITH SPECIFIC LEAD THROUGH STRUCTURE

[75] Inventors: Roland Huettinger, Jesenwang; Stefan Juengst, Zorneding, both of Germany

[73] Assignee: Patent-Truehand-Gesellschaft fuer Electriche Gluelampen mbH

[21] Appl. No.: 09/102,067

[22] Filed: Jun. 22, 1998

[30] Foreign Application Priority Data

Jun. 27, 1997 [DE] Germany ..... 197 27 430

[51] Int. Cl.[7] ..... H01J 5/50; H01J 5/46

[52] U.S. Cl. ..... 313/332; 313/326; 313/331; 313/623

[58] Field of Search ..... 313/623, 632, 313/633, 634, 635, 331, 624, 625, 626, 631, 326, 332

[56] References Cited

U.S. PATENT DOCUMENTS

| | | | |
|---|---|---|---|
| 4,780,646 | 10/1988 | Lange et al. | 313/623 |
| 4,864,191 | 9/1989 | Van De Weijer et al. | 313/633 |
| 5,363,007 | 11/1994 | Fromm et al. | 313/25 |
| 5,424,609 | 6/1995 | Geven et al. | 313/623 |
| 5,430,353 | 7/1995 | Feldman et al. | 313/623 |
| 5,552,670 | 9/1996 | Heider et al. | 313/625 |

FOREIGN PATENT DOCUMENTS

| | | | |
|---|---|---|---|
| 215524 | 7/1989 | European Pat. Off. | H01J 61/30 |
| 0587238 | 3/1994 | European Pat. Off. . | |
| 587238 | 3/1994 | European Pat. Off. | H01J 61/36 |
| 0639853 | 2/1995 | European Pat. Off. . | |
| 95/28732 | 4/1995 | WIPO | H01J 61/073 |

*Primary Examiner*—Nimeshkumar D. Patel
*Assistant Examiner*—Matthew J. Gerike
*Attorney, Agent, or Firm*—William H. McNeill

[57] ABSTRACT

The discharge vessel has two ends (6), which are closed off by ceramic plugs which each contain an elongate capillary tube (12), an electrically conductive lead-through (9, 10) comprising two parts (13, 14) being guided in a vacuum-tight manner through this plug capillary tube (12). The inner part (14) is a pin made of a halide-resistant metal (tungsten), the diameter of which is at most 0.4 mm and which is surrounded by a tubular casing (20, 21) made of ceramic material which consists of a concentric aluminum oxide tube (sleeve), the outer part (13), over its entire length, and the inner part (14), at least over a length of 1 mm from the beginning of the sleeve (20, 21), being sealed off by means of soldering glass (18).

12 Claims, 2 Drawing Sheets

METAL-HALIDE LAMP WITH SPECIFIC LEAD THROUGH STRUCTURE

The present application is closely related to the following applications: U.S. patent applications Ser. No. 08/883,853 and 08/883,939, both filed Jun. 27, 1997.

1. Field of the Invention

The invention is based on a metal-halide lamp with ceramic discharge vessel in accordance with the preamble of claim 1. It relates in particular to lamps with a discharge vessel which operates at a relatively high temperature, of the order of magnitude of up to 1000° C.

2. Prior Art

The main problem with lamps of this kind is the longterm sealing of the lead-through in the ceramic discharge vessel by means of a ceramic plug. Numerous proposals aimed at solving this problem have already been made. These solutions often solder or sinter a tube or pin made of metal (tungsten or molybdenum) as a lead-through into a plug made of ceramic.

EP-A-587,238 has disclosed a metal-halide lamp with ceramic discharge vessel in which a two-part lead-through in an elongate plug capillary tube is sealed off by means of soldering glass at that end of the plug which is remote from the discharge. The outer part of the lead-through consists of permeable material (niobium pin), while the inner part consists of halide-resistant material (for example a pin made of tungsten or molybdenum). The inner part may, in accordance with FIG. 2, have a casing made of a different halide-resistant metal. A further option is to wind a coil part around the pin (FIG. 8). However, the design proposed in this document is only suitable for relatively low outputs of up to 150 W at most, because the poor adaptation of the coefficients of thermal expansion often leads to cracks in the wall of the ceramic capillary tube at high outputs and correspondingly high temperature change loading. These cracks increase with increasing diameter of the molybdenum pin. An example given in FIG. 1 is a lamp with an output of 70 W, the lead-through of which is a molybdenum pin with a diameter of 0.7 mm.

EP-A-639,853 has disclosed a metal-halide lamp with ceramic discharge vessel in which the electrode itself is surrounded, within a long plug part (FIG. 4), by a sleeve tube made of aluminum oxide. This improves the ignition performance of the lamp. In that document, the diameter of the electrode shank is given as 1.2 mm.

SUMMARY OF THE INVENTION

The object of the present invention is to provide a metal-halide lamp with ceramic discharge vessel in accordance with the preamble of claim 1, the lead-through of which is designed in such a way that it is suitable not only for low wattages, but also, in particular, for higher wattages (typically of 150 to 400 W).

This object is achieved by means of the characterizing features of claim 1. Particularly advantageous refinements are given in the dependent claims.

Normally, with increasing wattage the diameter of the lead-through, and hence also the internal diameter of the plug capillary tube, also increase. In order nevertheless to reliably prevent cracks in the sealing region, therefore, a different solution has been developed.

In detail, this solution is a metal-halide lamp with ceramic discharge vessel made of aluminum oxide, the discharge vessel having two ends, which are closed off by means of ceramic plugs which each contain an elongate capillary tube (referred to below as plug capillary tube), and an electrically conductive lead-through, which with regard to the discharge comprises a pin-shaped inner part and an outer part, being guided in a vacuum-tight manner through this plug capillary tube. The lead-through is sealed on the outside of the plug by means of soldering glass. The shank of an electrode which protrudes into the interior of the discharge vessel is attached to the inside of the lead-through.

The inner part of the lead-through is a pin made of a halide-resistant metal, the diameter of which is at most 0.4 mm and which is surrounded by a tubular casing made of ceramic or metallic material (referred to below as the sleeve). The material of this ceramic sleeve contains aluminum. Preferably, it consists of aluminum oxide ($Al_2O_3$). However, it is also possible to use aluminum nitride (AlN) or aluminum oxynitride (AlON), since these materials are particularly halide-resistant. A particularly suitable metallic material is tungsten. The sleeve may also, in particular, be a combination of a plurality of ceramic and/or metallic parts.

The outer part of the lead-through is sealed with soldering glass over its length which is situated in the plug capillary tube. In addition, an adjoining region of the inner part of the lead-through is sealed by means of soldering glass over a length which at least also includes a small part of the length (approx. 1 to 2 mm) of the sleeve. In this case, it has proven essential for a long service life that the inner part be a pin which is so thin that despite the lack of adaptation to the thermal behavior of the aluminum-containing material it successfully withstands the changing thermal loading without the formation of cracks and flaws in the ceramic and also in the soldering glass. As a result, the niobium, which is susceptible to corrosion, of the outer part is reliably protected.

Preferably, the output of the lamp lies between 150 and 400 W, although lower outputs are also possible.

A stop for the sleeve is arranged on the inner part of the lead-through, on the discharge side, which stop is intended to prevent movement downward during the melt-in operation. It may comprise a bend in the inner part, a transverse piece of wire, a welding bead or the like. In the case of lamps of low wattage with the simultaneous use of sufficiently long electrode pins (more than 3 mm long), a long step at the end of the electrode shank can also be used as the stop. It is important to avoid overheating of the sleeve brought about by the hot electrode.

In any case, the sleeve should be at as short an axial distance as possible (typically between 0.1 and 0.5 mm) from the outer part (niobium pin). On the other hand, the distance between the sleeve and the shank of the electrode should, for the reasons given above, be at least 0.5 mm, and preferably more than 1 mm.

In a particularly preferred embodiment, the sleeve comprises at least two sections which are arranged axially behind one another. The small gap between the outer and inner sections stops the flow of the soldering glass. The inner end of the outer section of the sleeve thus defines the melt-in length for the soldering glass on the outside of the sleeve. Moreover, in practice it has been found that the soldering glass is also unintentionally sucked into the sleeve as far as the lead-through. The strong capillary forces in the sleeve may then suck the soldering glass forward into the vicinity of the electrode. A very particular advantage of a sleeve which is divided axially into two parts is that the outer section of the sleeve also acts as a barrier for this soldering glass situated on the inside. The inner section of the sleeve, which is subject to high-temperature loading, is therefore always free of soldering glass.

Advantageously, on the discharge side the outer part of the lead-through has a holding means for the inner part, in particular a step, a transverse slot or a blind bore. In a further embodiment, the entire outer part of the lead-through is designed as a tube (in particular made of niobium).

In all embodiments, the diameter of the inner part is significantly (more than 50%) less than the diameter of the outer part.

Particularly long service lives can be achieved if the diameter of the inner part is dimensioned in such a way that the current density through the inner part is at most 80 $A/mm^2$. As a result, excessive heating of the inner part and in particular of the sleeve is avoided.

In the case of lamps of relatively high wattage, it is necessary to introduce relatively large electrodes through a capillary tube, which necessarily has a relatively large internal diameter. In order to fill the dead volume, it is often advantageous here if the sleeve is constructed in one or two parts from concentric tubes. Its length preferably lies in the order of magnitude of at least 60%, preferably 80 to 90%, of the length of the inner part of the lead-through, in order for its ends to be free for the electrical connections. The dead volume in the front region of the inner part of the lead-through is advantageously filled by a closely adjacent coil of tungsten or molybdenum.

The present invention uses a two-part lead-through, comprising an outer part (in particular a pin or tube made of niobium, although the use of tantalum is also possible) which is matched in terms of thermal expansion to the aluminum oxide ceramic and is covered and sealed with soldering glass, and an inner part, which is halide-resistant and is only partly covered with soldering glass at its outer end and melted in. The inner part is a very thin wire made of molybdenum or in particular of tungsten, which has a higher melting point. The tungsten may contain an addition of rhenium, either as an alloying element or as a surface plating. The rhenium increases the high-temperature stability and corrosion resistance of the tungsten.

The inner part is connected on one side to the outer part (niobium pin) and on the other side to the electrode. A sleeve is drawn over this wire, which sleeve comprises one or more thin aluminum-containing capillary tubes, the external diameter of which is at least equal to that of the outer part. In this way, the considerable dead volume in the annular gap of the plug capillary tube, in which fill constituents may condense, is reduced. In addition, it has been found that an annular gap which is as small as possible improves the melting in by soldering glass. Furthermore, it is advantageous that the external diameter of the sleeve leaves only a capillary gap with respect to the plug capillary tube. The gap is approximately 30 $\mu$m wide. This is due to the dimension selected for the inner part ($\leqq$0.45 mm) and the fact that the same material is used for the sleeve as for the plug capillary tube (aluminum oxide). The external diameter of the sleeve may therefore be selected in such a way that it is precisely matched to the internal diameter of the plug capillary tube (to within a few $\mu$m), thus minimizing the dead volume.

The plug may be of one-part or multi-part design. For example, in a manner known per se a plug capillary tube may be surrounded by an annular plug part.

Finally, in contrast to the prior art the depth to which the outer part is inserted into the plug capillary tube is unimportant. A minimum depth of 2 mm is all that is required for a reliable seal. For thermal reasons, the maximum penetration depth should not exceed 50% of the length of the plug capillary tube.

Over its length situated in the plug capillary tube, the outer part is melted completely into the soldering glass, while the tungsten wire (and the sleeve) is melted in over a length of approximately 1 to 2 mm at its outer end. It is important that the niobium pin be completely covered with soldering glass, owing to the corrosive action of the fill on niobium.

The advantage of the inner part is that only a thin molybdenum or tungsten wire is melted in even when relatively thick niobium pins (up to 2 mm) are used. As a result, stresses caused by the insufficient matching of the coefficients of thermal expansion between molybdenum and $Al_2O_3$ are considerably reduced, since the absolute expansion is low. In contrast to tungsten or molybdenum, niobium is known to be well matched to the thermal expansion of aluminum oxide.

Tungsten is more advantageous as the wire material than molybdenum, particularly if the electrode is relatively short (shorter than the inner part). This is because the lower melting point of molybdenum (by comparison with tungsten) means that the risk of the welding point and the molybdenum pin behind the weld overheating as a result of the proximity to the hot electrode is greater. This would cause the weld to become detached or the molybdenum pin to soften and bend under the weight of the electrode, so that the electrode comes into contact with the wall of the discharge vessel, causing this wall to overheat locally. Moreover, tungsten is more corrosion-resistant than molybdenum. Furthermore, it has surprisingly emerged that with bromine-containing fills (with a molar fraction of bromine in the halogen (bromine, iodine) of at least 10%), tungsten is considerably better suited than molybdenum, since molybdenum reacts with bromine. Advantageously, an integral piece of tungsten wire which performs the role of both the inner part of the lead-through and of the electrode shank, can be used. As a result, it is possible to dispense with a welded joint.

It has been found that molybdenum or tungsten wires with a diameter of up to approximately 0.4 mm can be successfully melted into a ceramic tube made of aluminum oxide. At greater diameters, the absolute level of the expansion is high enough to entail the risk of cracks and leaks.

On the other hand, the cross-section of a 0.4 mm thick wire allows a residual current of up to approximately 10 A. This corresponds to a maximum current density of 80 $A/mm^2$. Critical electric heating occurs only above this level. The present invention thus allows a lamp output of up to 400 W.

In a particularly preferred embodiment, the casing of the inner part is a concentric double tube made of ceramic. This has advantages in terms of production engineering. Furthermore, the material of the inner and outer parts of the sleeve may readily be different (for example aluminum oxide with different doping).

FIGURES

The invention will be explained in more detail below with reference to a number of exemplary embodiments. In the drawings:

FIG. 1 diagrammatically shows a metal-halide lamp with ceramic discharge vessel FIG. 2 diagrammatically shows a detailed view of the end region of the lamp shown in FIG. 1

FIG. 3 diagrammatically shows a further exemplary embodiment of an end region FIG. 4 diagrammatically shows a further exemplary embodiment of an end region.

Figure 1:
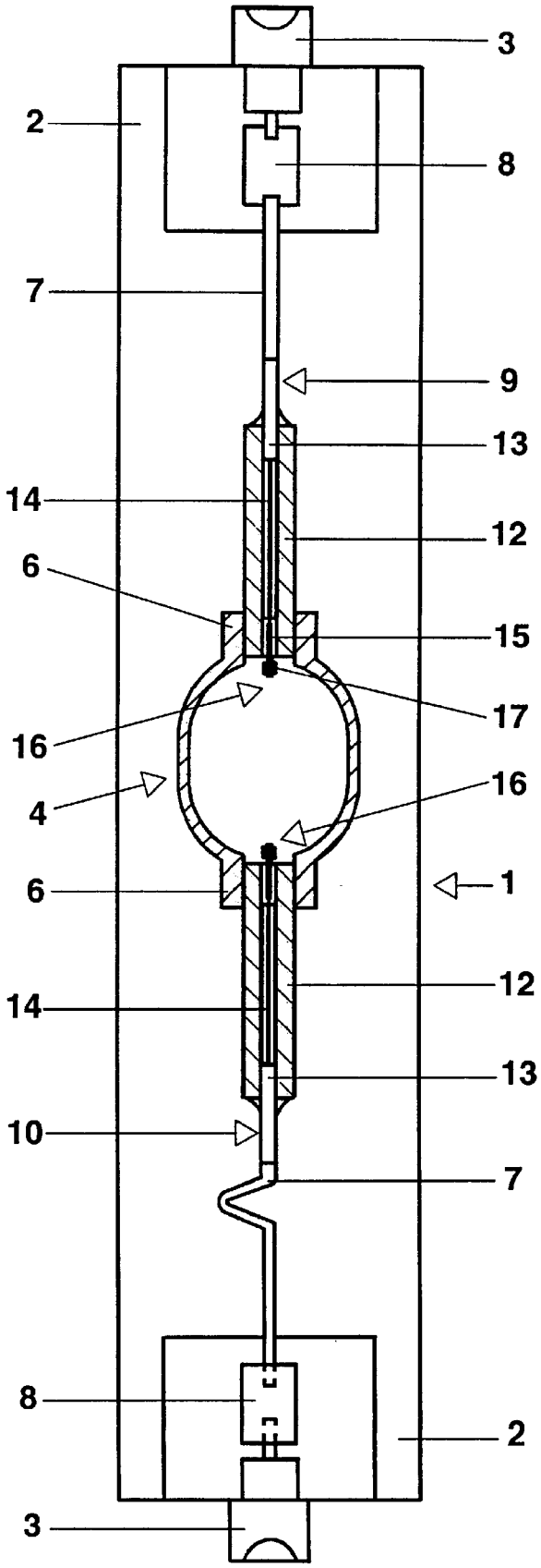
FIG. 1 diagrammatically depicts a metal-halide lamp with an output of 150 W. It comprises a cylindrical outer bulb 1, which defines a lamp axis, is made of quartz glass and is pinched (2) and capped (3) on two sides. The axially arranged discharge vessel 4, which is made of $Al_2O_3$ ceramic, is of cylindrical or bulged shape and has two ends 6. It is held in the outer bulb 1 by means of two supply conductors 7, which are connected to the cap parts 3 via foils 8. The supply conductors 7 are welded to lead-throughs 9, 10, which are each fitted in an end plug 12 at the end 6 of the discharge vessel. The plug part is designed as an elongate capillary tube 12 (plug capillary tube). The end 6 of the discharge vessel and the plug capillary tube 12 are directly sintered together.

The lead-throughs 9, 10 each comprise two parts. The outer part 13 is designed as a niobium pin and projects into the capillary tube 12 over about a quarter of the length of the latter. The inner part 14 extends inside the capillary tube 12, toward the discharge volume. On the discharge side, it holds electrodes 16, comprising an electrode shank 15 made of tungsten and a coil 17 which is pushed onto the discharge-side end. The inner part 14 of the lead-through is in each case welded to the electrode shank 15 and to the outer part 13 of the lead-through.

The fill of the discharge vessel consists, in addition to an inert firing gas, e.g. argon, of mercury and additions of metal halides. It is also possible, for example, to use a metal halide fill without mercury, in which case a high pressure is selected for the firing gas xenon.

Figure 2:
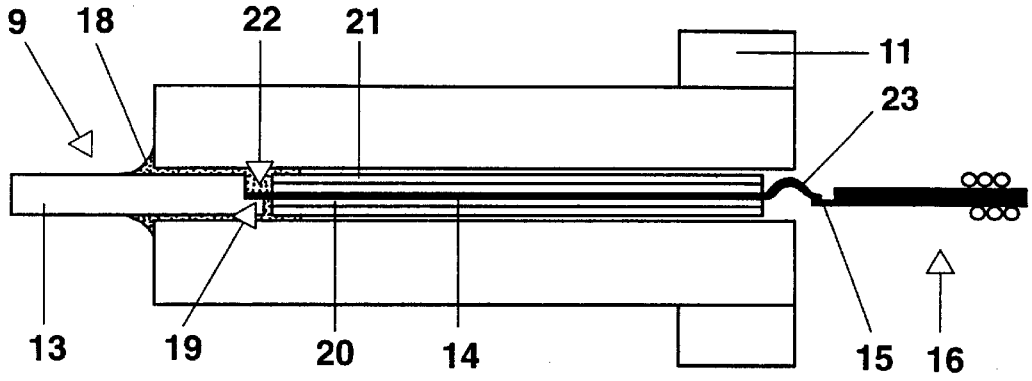

FIG. 2 shows a detailed view of an end region of the discharge vessel. The lead-through 9 is provided by a system comprising a niobium pin as the outer part 13 having a diameter of 1.1 mm and a thin tungsten pin (diameter 0.25 mm) as the inner part 14, over which two $Al_2O_3$ capillary tubes 20, 21, which fit suitably inside one another, are pushed as the sleeve. The outer tube 21 has an external diameter of 1.1 mm and an internal diameter of 0.62 mm, while the inner tube 20 has an external diameter of 0.58 mm and an internal diameter of 0.3 mm. The total length of the capillary tube 12 is approximately 17 mm, while that of the tungsten pin 14 is approximately 15 mm and that of the electrode is approximately 5 mm, with a shank diameter 15 of 0.5 mm.

On the discharge side, a step 22 is ground on the niobium pin. The tungsten pin 14 is attached to the step 22 by a resistance weld 19. The step is high enough for it to impart sufficient guidance to the tungsten pin 14 for the latter to rest precisely in the center. This is important in order for it to be possible to align the system as a whole centrally and introduce it correctly into the two-part sleeve (capillary tube 20, 21).

On the discharge side, the tungsten pin is welded to the electrode shank 15 in the same way, the electrode shank 15 also having a step for the same reasons as those given above.

The niobium pin 13 is inserted into the plug capillary tube 12 to a depth of approximately 3 mm and is sealed by means of soldering glass 18. The sleeves 20, 21 end close to the niobium pin (distance 0.1–0.5 mm), so that the soldering glass can easily wet this gap, thus completely covering the niobium, and so that the beginning of the inner part (1 to 2 mm) is also covered by the soldering glass.

In order to prevent the tubes from moving downward under the force of gravity during the vertical melting-in, they have to be held in position by a stop. In this case, this effect is achieved by means of a curved bulge 23 in the tungsten pin. However, the end of the tungsten pin 14 may also be bent to form a coil. One to two turns are preferably sufficient. In an exemplary embodiment of a 250 W lamp in accordance with FIG. 2, the niobium pin 13 has a diameter of 1.3 mm. The tungsten pin 14 has a diameter of 0.35 mm. The inner capillary tube 20 has an external diameter of 0.8 mm, and the outer capillary tube 21 has an external diameter of 1.2 mm. The total length of the tungsten pin is 14.5 mm, while that of the electrode is 3.5 mm with a diameter of 0.7 mm. The distance of the capillary tubes 20, 21 from the niobium pin and from the electrode is 0.5 mm in each case. The capillary tube 12 of the plug has a length of approximately 18 mm. The niobium pin rests therein to a depth of approximately 2.5 mm.

Figure 3:
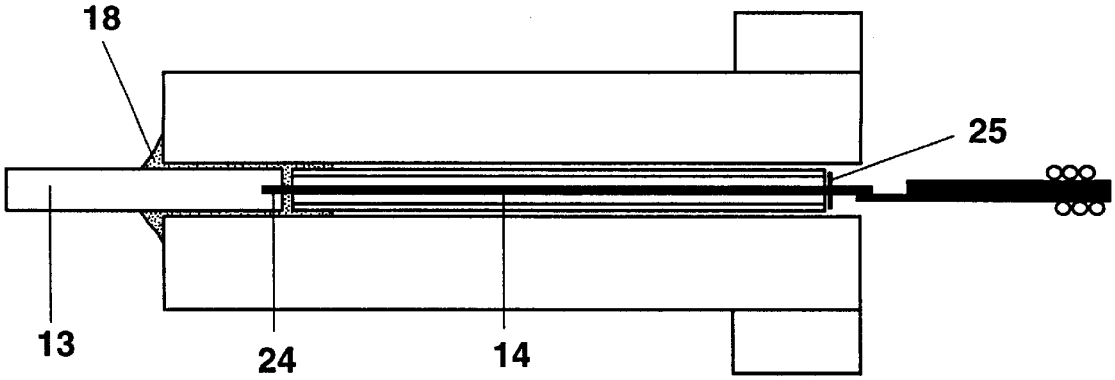

FIG. 3 shows a further exemplary embodiment. In this case, the niobium pin 13 has a blind bore 24 on the discharge side, in which bore the tungsten pin 14 is inserted and welded. This arrangement ensures precise centering. The stop is in this case a piece of wire 25, which is attached to the tungsten pin in the vicinity of the discharge-side end of the tungsten pin, transversely to the axis of the lamp. It has been found that the sleeve should not come into direct contact with the electrode, since if it were to do so the thermal loading could lead to the aluminum oxide reacting with the constituents of the fill. It is therefore recommended very generally that the minimum distance between the capillary tubes and the electrode be at least 0.5 mm. Preferably, the distance is greater than 1 mm.

The stop may also be a flattening or welding bead or the like on the lead-through pin made of tungsten.

A further possibility for precise centering of the inner lead-through part results from the use of a niobium tube as the outer part. The internal diameter of the niobium tube is selected in such a manner that the inner part (tungsten pin) fits correctly into the internal bore of the tube.

Figure 4:
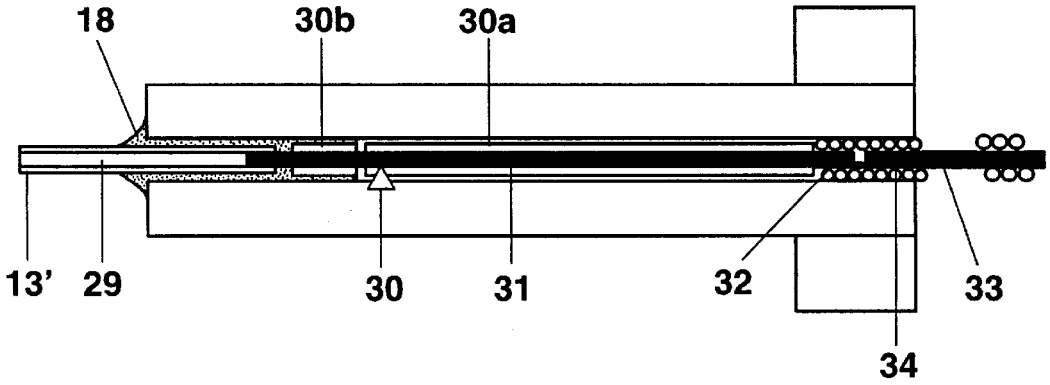

FIG. 4 shows a further exemplary embodiment of an end region of a discharge vessel with an output of 70 W. In this case, a sleeve 30 of simple design (external diameter 0.6 mm) surrounds a tungsten pin 31 with a diameter of 0.2 mm. The three-part sleeve is formed from two outer sections 30*a*, 30*b* arranged axially behind one another and an internal coil part 34. The short outer section 30*b* serves as a barrier to the penetration of the soldering glass 18.

The tungsten pin 31 is attached to a step 32 on the electrode shank 33. In this case, the step 32, which is at least 0.5 mm high, simultaneously serves as a stop for the central section 30*a* of the sleeve 30. The dead volume in the region close to the discharge in front of the long inner central section 30*a* of the sleeve 30 is filled by the coil part 34 made of molybdenum.

However, a technique of this nature is only possible at a relatively low output (below 100 W), because otherwise the flow of heat to the sleeve would become too high. Moreover, the use of long electrode pins (typically 5 mm long) is advisable.

In this case, the outer part is a niobium tube 13' with a bore 29, into the front end of which the tungsten pin 31 is introduced as the inner part, where it is welded.

In a further exemplary embodiment which is similar to FIG. 4, the tungsten pin extends over the entire length of the niobium tube and is welded to the latter at one end of the niobium tube. The sleeve is either a sleeve tube made of aluminum oxide or a coil made of rhenium-doped tungsten.

What is claimed is:

1. A metal-halide lamp with ceramic discharge vessel (4) made of aluminum oxide, the discharge vessel having two ends (6), which are closed off by means of ceramic plugs which each contain an elongate capillary tube (12)—referred to below as plug capillary tube—and an electrically conductive lead-through (9, 10), which with regard to the discharge comprises a pin-shaped inner part (14) and an outer part (13), being guided through this plug capillary tube (12) and being sealed on the outside with soldering glass, an electrode (16) with a shank (15) being attached to the lead-through, which electrode protrudes into the interior of the discharge vessel, wherein the inner part (14) is a pin made of a halide-resistant metal, the diameter of which is at most 0.4 mm and which is surrounded by a tubular casing (20, 21)—referred to below as the sleeve—made of metallic or ceramic material which contains aluminum, the outer part (13), at least over its length which is situated in the plug, and an adjoining region of the inner part (14), over a length which includes at least a small part of the length of the sleeve (20, 21), being sealed by means of soldering glass (18).

2. The metal-halide lamp with ceramic discharge vessel as claimed in claim 1, wherein the inner part (14) consists of tungsten, to which rhenium is added if appropriate, and wherein the outer part (13) consists of niobium.

3. The metal-halide lamp with ceramic discharge vessel as claimed in claim 1, wherein the sleeve (20, 21; 30) extends over at least 60% of the length of the inner part (14).

4. The metal-halide lamp with ceramic discharge vessel as claimed in claim 1, wherein the sleeve comprises a plurality of axial sections.

5. The metal-halide lamp with ceramic discharge vessel as claimed in claim 1, wherein a stop (23, 25) for the sleeve (20, 21; 30) is arranged on the inner part on the discharge side.

6. The metal-halide lamp with ceramic discharge vessel as claimed in claim 1, wherein the sleeve (20, 21; 30) is at a minimum distance of 0.5 mm from the shank of the electrode.

7. The metal-halide lamp with ceramic discharge vessel as claimed in claim 1, wherein the outer part (13) of the lead-through is a tube (13') with the inner part (14) fitted in its bore (29).

8. The metal-halide lamp with ceramic discharge vessel as claimed in claim 1, wherein the outer part (13) of the lead-through is a pin which, on the discharge side, has a holding means for the inner part (14), in particular a step (22), a slot or a blind bore (24).

9. The metal-halide lamp with ceramic discharge vessel as claimed in claim 1, wherein the inner part (14) consists of tungsten, a fill containing more than 10 mol% of bromine as a halogen.

10. The metal-halide lamp with ceramic discharge vessel as claimed in claim 1, wherein the diameter of the inner part (14) is less than 50% of the diameter of the outer part (13).

11. The metal-halide lamp with ceramic discharge vessel as claimed in claim 1, wherein the diameter of the inner part (14) is dimensioned in such a way that the current density through the inner part is at most 80 $A/mm^2$.

12. The metal-halide lamp with ceramic discharge vessel as claimed in claim 1, wherein the sleeve (20, 21; 30) is formed in one or two parts from concentric tubes.

* * * * *